US006874862B2

(12) United States Patent
Shade

(10) Patent No.: US 6,874,862 B2
(45) Date of Patent: Apr. 5, 2005

(54) INKJET PRINTING DEVICE WITH MULTIPLE NOZZLES POSITIONED TO PRINT AT EACH TARGET LOCATION ON A PRINT MEDIUM

(75) Inventor: David A. Shade, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/133,621

(22) Filed: Apr. 26, 2002

(65) Prior Publication Data

US 2003/0202040 A1 Oct. 30, 2003

(51) Int. Cl.[7] ..... B41J 2/15
(52) U.S. Cl. ..... 347/40
(58) Field of Search ..... 347/40, 41, 42, 347/43, 20, 44, 47, 54, 55

(56) References Cited

U.S. PATENT DOCUMENTS

| | | | | |
|---|---|---|---|---|
| 4,963,882 | A | | 10/1990 | Hickman |
| 5,124,720 | A | | 6/1992 | Schantz |
| 5,640,183 | A | | 6/1997 | Hackleman |
| 5,880,757 | A | | 3/1999 | Ta |
| 6,076,910 | A | | 6/2000 | Anderson |
| 6,154,230 | A | * | 11/2000 | Holstun et al. |
| 6,278,469 | B1 | | 8/2001 | Bland et al. |
| 6,283,572 | B1 | | 9/2001 | Kumar et al. |
| 6,302,511 | B1 | | 10/2001 | Neese et al. |
| 6,517,180 | B2 | * | 2/2003 | Tullis et al. ..... 347/19 |

* cited by examiner

*Primary Examiner*—Raquel Yvette Gordon

(57) ABSTRACT

An inkjet printing device includes an inkjet print head with nozzles for ejecting drops of ink or fluid and a print medium transport system for feeding a print medium passed the print head. At least two of the nozzles of the print head are positioned to print a spot at each target location on the print medium during operation of the printing device.

10 Claims, 9 Drawing Sheets

INKJET PRINTING DEVICE WITH MULTIPLE NOZZLES POSITIONED TO PRINT AT EACH TARGET LOCATION ON A PRINT MEDIUM

FIELD OF THE INVENTION

The present invention relates to the field of inkjet printing. More particularly, the present invention relates to a method and systems for improving print quality in an inkjet printing device by positioning at least two nozzles of a print head to print a spot at each target location on a print medium during operation of the printing device.

BACKGROUND OF THE INVENTION

Inkjet printers work by spraying ink at a sheet of paper or other print medium to create images or text. Inkjet printers are capable of producing high quality print approaching that produced by laser printers. Inkjet printers are generally less expensive than laser printers, but can also be considerably slower.

To produce words or pictures contained in data received by a printer from a host computer or network, the inkjet printer squirts drops of ink through extremely tiny nozzles. Bundled together, the hundreds of nozzles form a print head, which travels across the paper printing a horizontal line of the image. The nozzles fire many times per second. After completing a line, the paper is advanced and the next strip of the image is printed. This continues until the page is complete.

There are two basic types of inkjet printers: thermal and piezo. Most inkjet printers use thermal inkjet technology, which heats the ink to create a bubble that forces a drop of ink out of the nozzle. Tiny resistors may be used to rapidly heat a thin layer of liquid ink causing the bubble to form. As the nozzle cools and the bubble collapses, it creates a vacuum that draws more ink from a cartridge to replace the ink that was ejected. This process is repeated thousands of times per second. The time required to heat and then cool the nozzle theoretically slows printing speeds.

In contrast, piezoelectric inkjet printing, commonly referred to simply as piezo, pumps ink through nozzles using pressure. The print head regulates the ink by means of an electrical current passed through a material that swells in response to the electrical current to force ink onto the paper. Piezo print heads require vacuum pumps and large ink-absorbent pads to keep nozzles printing reliably. Piezo mechanical stability is also highly sensitive to small air bubbles, and the system may also need flushing with ink to purge trapped air, a process that wastes ink.

There are many causes of printing errors when using inkjet print heads. These problems mostly relate to a nozzle that is, for a variety of reasons, not functioning properly. For example, the expected drop of ink from a given nozzle may be misdirected or missing entirely due to manufacturing variations, material or geometry defects, resistor film defects, contamination, kogation, ink clogging, ink crystallization, nozzle plugging, etc. The result is an undersized, missing or misplaced dot on the print media. The print quality is consequently degraded and will be noticeably inferior to the human eye. If the output of the printer is to be optically scanned, photocopied or otherwise processed electronically, the defects will again be apparent.

SUMMARY OF THE INVENTION

In one embodiment, the present invention may be described as an inkjet printing device having an inkjet print head with nozzles for ejecting drops of ink or fluid and a print medium transport system for feeding a print medium passed the print head. During operation of the printing device, at least two of the nozzles of the print head become positioned to print a spot at each target location on the print medium to provide redundancy for weak or defective nozzles.

The present invention may also be embodied in a method of improving print quality in an inkjet printing device by positioning at least two nozzles of a print head to print a spot at each target location on a print medium during operation of the printing device.

BRIEF DESCRIPTION OF THE DRAWINGS

The accompanying drawings illustrate embodiments of the present invention and are a part of the specification. Together with the following description, the drawings demonstrate and explain the principles of the present invention. The illustrated embodiments are examples of the present invention and do not limit the scope of the invention.

Throughout the drawings, identical reference numbers designate similar, but not necessarily identical, elements.

DETAILED DESCRIPTION OF EMBODIMENTS OF THE INVENTION

Figure 1:
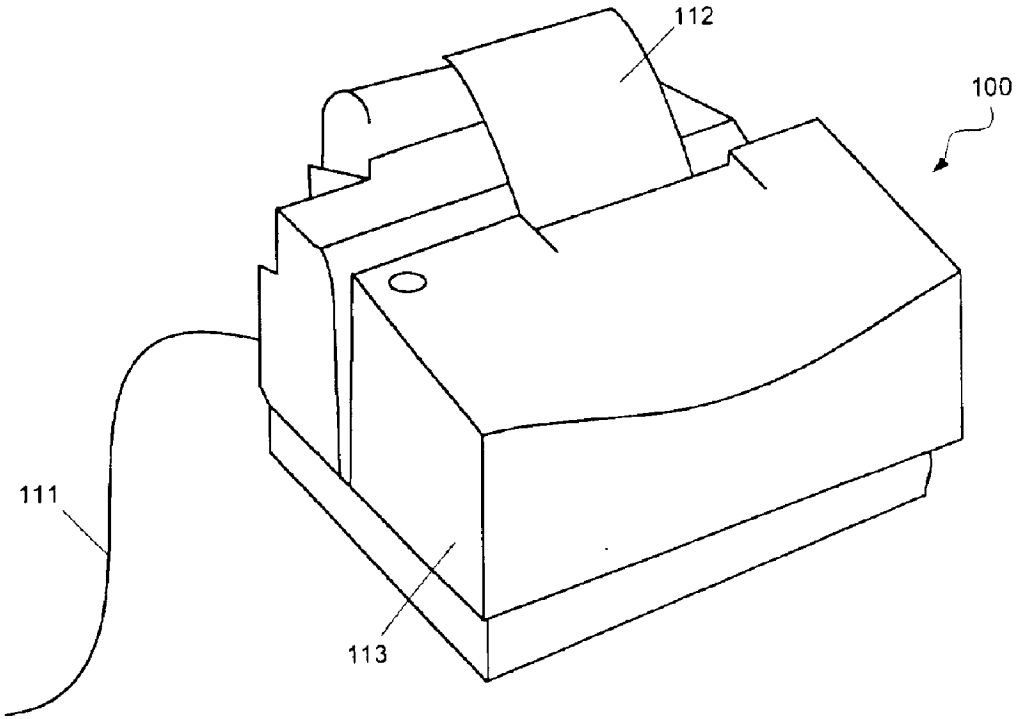
FIG. 1 is an illustration of a Point-of-Sale (POS) inkjet printer in which the present invention can be implemented.

FIG. 1 is an illustration of a Point-of-Sale (POS) printer that uses inkjet technology. As the name indicates, a POS printer (100) is used at the point of sale or other transaction is made to print, for example, a receipt or other documentation of the transaction. A POS printer may be located at, for example, a retail checkout counter, a bank teller's window, a warehouse loading facility, a restaurant, an automatic teller machine, etc. A POS printer may be located anywhere a transaction is completed where written documentation of the transaction is desired.

As shown in FIG. 1, a typical POS printer (100) may include a housing (113) in which the print head, print medium feeding mechanism and other components are housed. A print medium, typically a continuous roll of paper (112), is feed through the printer (100). Sections of the paper (112) are then torn off or auto cut when printed.

The printer (100) is typically connected (111) to a host device, for example, a cash register, a personal computer, a server providing credit information, etc. This host device will provide some or all of the data which the printer (100) then prints on the print medium to document the transaction.

A feature of POS printers, particularly thermal POS printers, is that the print head is typically stationary. However, some POS printers, including inkjet POS printers, may have a scanning head. Where the print head is stationary, the print head is formed so as to be wide enough to cover the entire printing area on the strip of print medium (112). Thus, the print head need not move, but rather remains stationary as the print medium (112) is fed passed the print head. As described above, when one line of the printing has been finished, the print medium (112) is advanced to allow for the next line to be printed.

The present invention provides a number of means for correcting the degradation of print quality in an inkjet print head due to the malfunctioning of a nozzle of the print head. The principles of the present invention are particularly applicable to a stationary print head and are, therefore, also particularly applicable to a POS printer (e.g. 100) which may employ a stationary print head. However, the present invention is not limited to POS printers. The principles of the present invention can be applied to any printing device, particularly those with non-scanning print heads.

Figure 2:
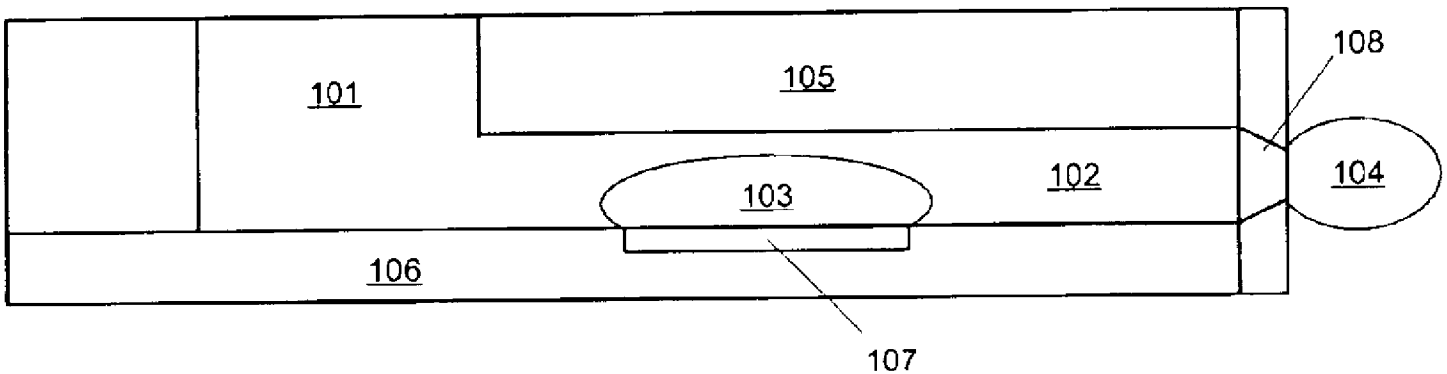
FIG. 2 is an illustration of a nozzle structure in a thermal inkjet print head.

FIG. 2 illustrates the operation of a functioning nozzle of a thermal inkjet print head. As shown in FIG. 2, the print head (105) includes multiple inkjet nozzles (108) formed on a common substrate (106). Associated with each nozzle (108) is a heating element (107), for example, a resistor. The nozzle (108) is connected to a nozzle chamber (102) within which the heating resistor (107) is located.

To fire ink from the nozzle chamber (102), a drive system on the substrate (106) outputs a firing pulse to the heating resistor (107). The firing pulse is, for example, a current pulse of sufficient magnitude to heat up the resistor (107) enough to heat the ink to a firing temperature. At this temperature, a bubble (103) forms in the ink at the heating resistor (107). The expansion of this bubble (103) forces a drop of ink (104) out the nozzle (108). The ink (104) ejects from the nozzle (108) toward a print media sheet.

After the heating resistor (107) has been fired, the bubble (103) collapses as the resistor (107) cools. This creates a vacuum that pulls more ink from an ink cartridge or supply through an inlet (101) into the nozzle chamber (102). The nozzle (108) is then ready to fire again when the resistor (107) is heated. A controller circuit (not shown) determines when any given nozzle is to fire based on the data that defines the image or text being printed by the print head (105).

As noted above, there are a wide variety of reasons why the nozzle (108) may fail to function properly. Due to any or all of these problems, the nozzle (108) may misdirect the ink drop (104), expel only a fraction of the necessary drop (104) or fail to fire a drop at all.

These errors can be totally eliminated or significantly reduced by successively placing redundant drops of ink on top of or near the target location on the print medium. One straightforward way to accomplish this is to provide a backup, redundant nozzle for each principal nozzle in the print head.

It should be noted that the thermal inkjet print head illustrated is a side-firing configuration. Top-firing configurations, in which the heating element is vertically under the nozzle are also popular. The present invention can be practiced with any thermal inkjet configuration.

Figure 3:
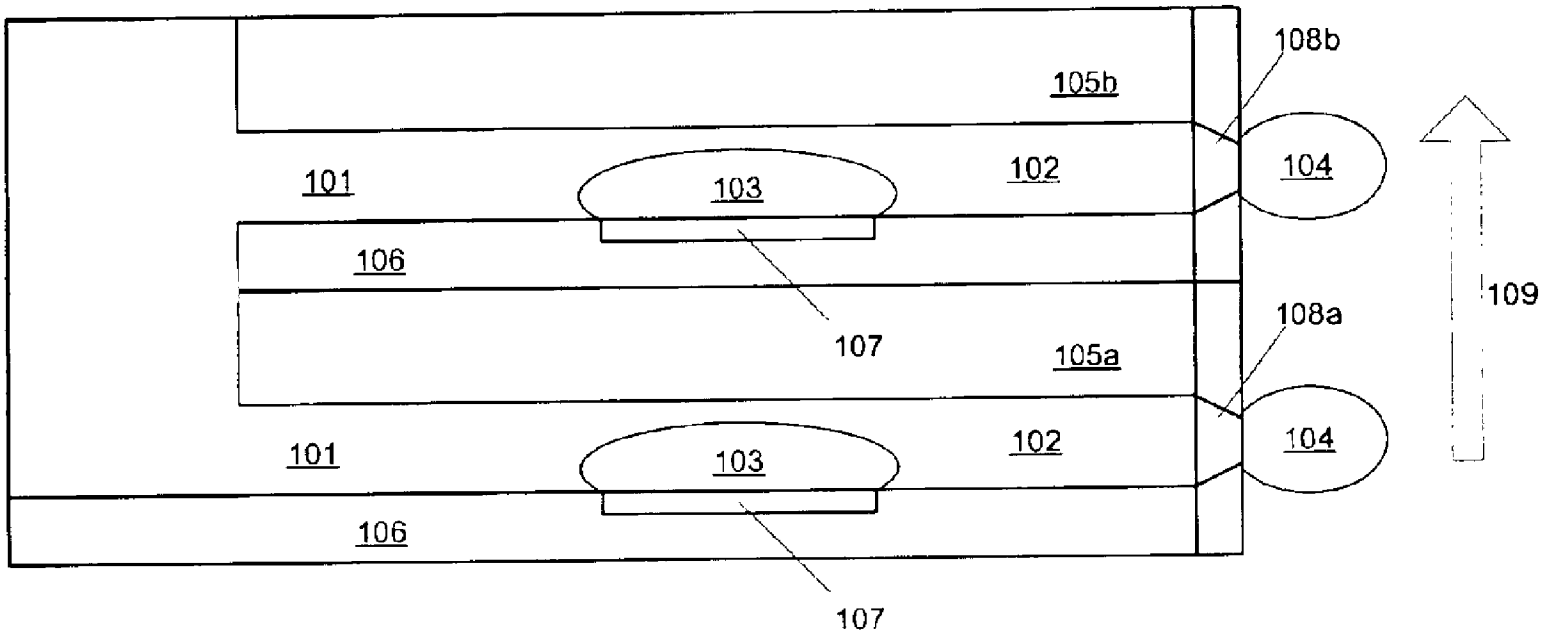
FIG. 3 is an illustration of a redundant nozzle structure in a thermal inkjet print head according to principles of the present invention.

FIG. 3 illustrates a thermal inkjet print head according to principles of the present invention in which each nozzle (108*a*) is backed up by a second nozzle (108*b*). As shown in FIG. 3, the print head structure is duplicated to support redundant nozzles (108*a*, 108*b*). The nozzles (108*a*, 108*b*) are spaced apart along the direction (109) in which the print medium moves, whether side-, bottom- or top-firing.

Consequently, when a print job is being executed, the print medium moves into position in front of the first nozzle (108*a*). This nozzle (108*a*), if appropriate to the data being printed, fires or attempts to fire an ink drop (104). If the nozzle (108*a*) is functioning properly, the ink drop is discharged and makes a sufficient spot at the target location on the print medium.

However, for any of the reasons discussed above, the nozzle (108*a*) may be malfunctioning and this drop (104) may be misdirected, unacceptably reduced in volume or absent all together. In any such event, a spot of sufficient magnitude is not made on the print medium at the target location.

The print medium is then advanced along the transport path (109). When the target location arrives at the second nozzle (108*b*), the second nozzle (108*b*) can be fired to again attempt to print a spot of sufficient magnitude at the target location on the print medium. If the first nozzle (108*a*) is functioning properly, the second nozzle (108*b*) will merely darken the spot already appropriately printed by the first nozzle (108*a*) and the use of second nozzle (108*b*) will be largely pointless.

However, if the first nozzle (108*a*) was malfunctioning, the second nozzle (108*b*) can attempt to appropriate place the desired ink spot on the print medium so that the resulting print quality is not degraded by the malfunctioning of the first nozzle (108*a*). In this way, with redundant nozzle firing at each target location on the print medium, the overall print quality is less affected by malfunctioning nozzles.

It will be appreciated that in some instances, it may be the first nozzle (108*a*) that is functioning properly and the second nozzle (108*b*) that is malfunctioning. However, so long as one of the nozzles (108*a*, 108*b*) is working properly, the necessary spot will be printed at the target location on the print medium. Thus, in one embodiment of the present invention, each nozzle of the print head is duplicated and the two redundant nozzles are both fired at each target location when a spot is to be printed. This will greatly increase the chances that each target location will be printed with the necessary spot to create the desired text or image on the print medium.

However, as will be readily appreciated, if both the nozzles of each pair are functioning properly, firing both nozzles at the target location is both pointless and a waste of resources. A second embodiment of the present invention, illustrated in FIG. 4, addresses these considerations. While thermal inkjet technology has been illustrated and discussed in FIGS. 2 and 3, it will be appreciated that all the principles of the present invention could equally well be applied to any inkjet print head, including a piezo inkjet print head.

Figure 4:
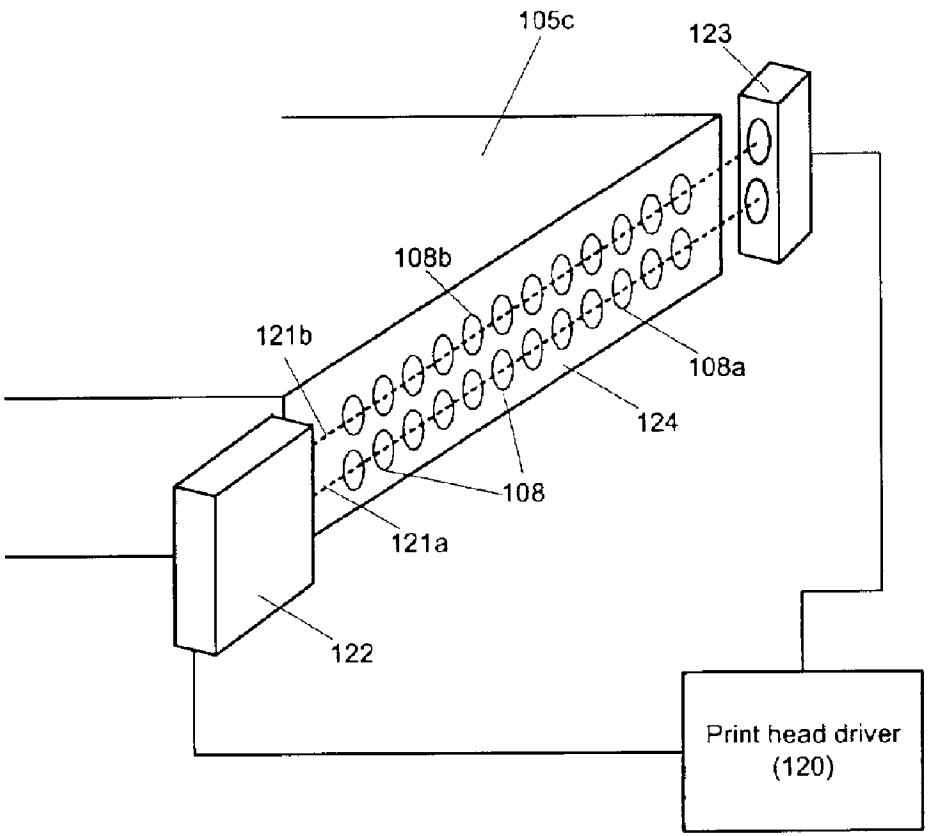
FIG. 4 is an illustration of an orifice plate with redundant nozzles being monitored by an optical system according to principles of the present invention.

FIG. 4 illustrates a print head (105*c*), according to principles of the present invention, in which each nozzle is duplicated by a redundant nozzle that is spaced from the primary nozzle along the direction of the print medium transport path. As shown in FIG. 4, there may result in a print head (105*c*) with an orifice plate (124) on which the nozzles (108) are organized into a lower row (108*a*) and an upper row (108*b*), the rows being spaced along the print medium transport path.

The print head driver (120) is responsible for receiving the print data that is to be rendered on the print medium and for selectively firing the nozzles (108) of the print head (105*c*) as the print medium moves passed the print head (105*c*) to form the desired text or images on the print medium. In the embodiment described above in connection with FIG. 3, the print head driver would fire each of the nozzles in a nozzle pair at every target location on the print medium to ensure print quality.

However, in the present embodiment, an optical detection system is provided adjacent the orifice plate (124) of the print head (105*c*). The purpose of this system, as will be explained in detail, is to evaluate the performance of each of the nozzles in each nozzle pair so that only the best functioning nozzle is fired, rather than automatically firing both nozzles to promote print quality.

As shown in FIG. 4, the optical detection system can include a transmitter (122) at one end of the print head (105*c*) and a receiver (123) at the opposite end. The transmitter (122) transmits two beams of radiation, an upper (121*b*) and a lower (121*a*). The transmitter (122) is aligned so that the upper beam (121*b*) passes in front of each of the nozzles (108) in the upper row of nozzles (108*b*), while the lower beam (121*a*) passes in front of each of the nozzles (108) in the lower row of nozzles (108*a*).

The beams emitted by the transmitter (122) can be any type of radiation that will be interfered with by a drop of ink or fluid from a nozzle (108). For example, the transmitter (122) is preferably an optical or laser transmitter.

During a servicing or evaluation routine, the transmitter (122) will activate the beams (121*a*, 121*b*). These beams (121*a*, 121*b*) are individually received and detected by the receiver (123).

With the beams (121*a*, 121*b*) in place, the print head driver (120) can sequentially fire all the nozzles (108) in the print head. When a given nozzle (108) fires, the ejected drop of ink or fluid will enter and break one of the beams (121*a*, 121*b*) on that beam's path between the transmitter (122) and the receiver (123). If the drop is of a full and appropriate volume, the interference with the beam (121*a*, 121*b*) will be maximized. If the nozzle is partially clogged or otherwise decreases the volume of the ejected drop below an optimal quantity, or if the drop is misdirected along an erroneous trajectory, the interference caused in the beam (121*a*, 121*b*) by that drop will also be proportionately diminished. The fact, as well as the amount, of interference each drop causes in the beams (121*a*, 121*b*) will be detected by the receiver (123) and reported to the print head driver (120). Alternately, multiple beams and receivers may be positioned in such a way as to detect trajectory errors, reduced volume drops, etc.

Consequently, the print head driver (120) can determine which nozzle (108) in each nozzle pair is functioning best. In some instances, only one of the two nozzles may expel a drop that is detected when it breaks one of the beams (121*a*, 121*b*) between the transmitter (122) and the receiver (123). In such a case, the print head driver (120) will deactivate the nozzle that failed to fire, as there will be no point in attempting to fire that nozzle during an actually printing operation.

In other cases, both nozzles (108) in a pair may successfully expel a drop, but one of the drops may be misdirected or of insufficient volume. Or, both drops may be somewhat misdirected or of less than optimal volume. By examining which drop more fully occludes the adjacent beam (121*a*, 121*b*), as registered by the receiver (123), the print head driver (120) can determine which nozzle (108) in the pair is functioning best. The other nozzle may then be deactivated during subsequent printing operations.

In this way, the print head driver (120) can, after completing the servicing or evaluation routine, identify which nozzle (108) in each redundant nozzle pair is functioning best and can provide the best print quality. The other nozzle (108) in the pair is then not used during subsequent printing operations in favor of the nozzle (108) that has been demonstrated to be functioning more optimally. Consequently, the waste of resources involved in firing both nozzles (108) in a pair every time a target location is presented can be avoided.

As will be appreciated by those skilled in the art, the optical detection system described above can be configured in a wide variety of ways to accomplish the objective of testing the nozzles in each nozzle pair. For example, the positions of the transmitter and receiver can be reversed, or the transmitter and receiver may provide beams vertically, rather than horizontally, across the nozzles of the orifice plate. Different forms of radiation beam may be used. A wide variety of detector technologies may be employed. The nozzles may not be arranged in horizontal rows, requiring angled or additional beams to cover each nozzle outlet. Any and all such modifications are within the scope and spirit of the present invention. According to the present invention, any system can be used that provides for evaluation of the relative functioning of nozzles in a nozzle pair to identify the better nozzle for use during printing.

Figure 5:
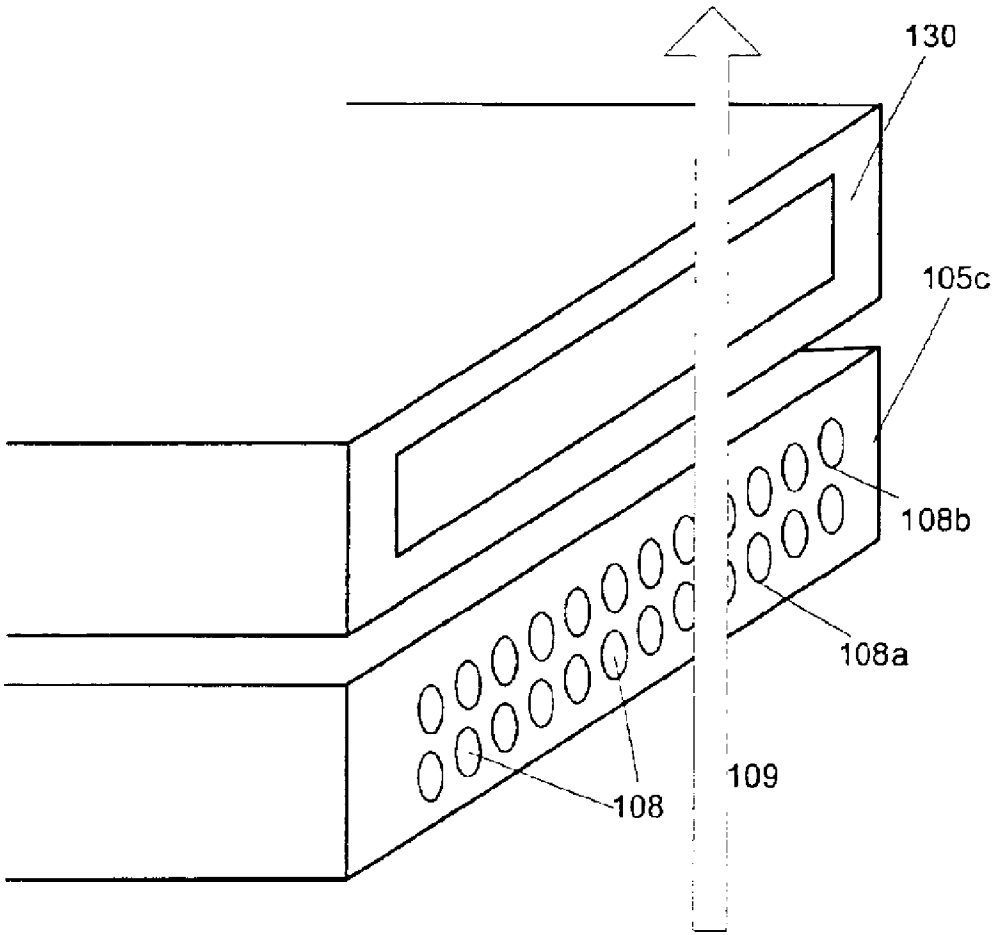
FIG. 5 is an illustration of an orifice plate with redundant nozzles being monitored by an optical scanner located along the transport path for the print media according to principles of the present invention.

FIG. 5 illustrates another embodiment of the present invention in which another mechanism is used to evaluate the performance of each nozzle in each nozzle pair so that only the best performing nozzle in each pair is fired during actual printing. As shown in FIG. 5, an optical scanner (130) may be provided adjacent to the print head (105*c*) along the print medium transport path (109).

In the present embodiment, during a servicing or evaluation routine, a sheet or strip of a print medium is positioned adjacent the print head (105*c*). The print head driver then fires each of the nozzles (108) in the print head (105*c*) at a different target location on the print medium. In this routine, nozzle pairs are not fired at the same target location, but at different target locations.

The print medium is then advanced so that the spots printed on the print medium by firing all the nozzles are presented to an optical scanner (130). The optical scanner (130) uses known optical scanning technology in which, for example, a bright light is directed at the print medium while the scanner (130) detects and digitizes the image on the print medium. The print pattern is preferably optimized for reliable detection by a low-resolution dot scanning method. With the output of the scanner (130), the spot made by each individual nozzle (108) can be evaluated.

For example, if a nozzle (108) is failing to expel ink, the scanner (130) will detect that no spot was printed at a particular target location where that nozzle (108) was to have made a spot. That empty target location will correspond to a particular nozzle (108). The absence of a spot at that target location can then be attributed to the appropriate non-functioning nozzle.

Similarly, if a nozzle (108) is partially blocked or otherwise expelling a drop of reduced volume, the resulting spot on the print medium will be less dark than a spot from a properly functioning nozzle. This lack is detected by the scanner (130) which can distinguish how light or dark a spot on the print medium is. The deficient spot is then attributed to the corresponding malfunctioning nozzle based on the location of the spot on the print medium. That target location will correspond to a particular nozzle (108).

Consequently, based on the output of the scanner (130), the print head controller can again determine which nozzle in each nozzle pair is the best performing. The other nozzle of the pair is then deactivated and not fired during printing operations until the next servicing and verification interval.

Figure 6:
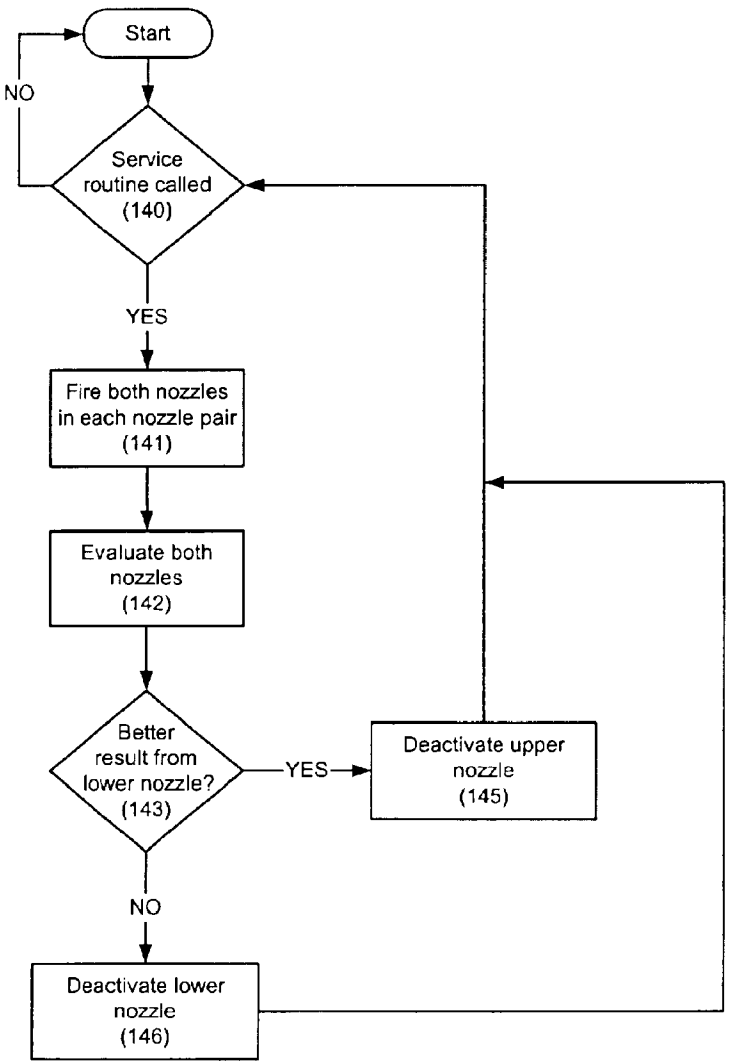
FIG. 6 is flowchart illustrating the process of monitoring the performance of redundant nozzle pairs and selecting only the better functioning nozzle of the pair for printing operation.

FIG. 6 is a flowchart illustrating a method according to principles of the present invention. The method illustrated in FIG. 6 underlies the operation of, for example, the embodiments illustrated and described in FIGS. 4 and 5.

As shown in FIG. 6, the method begins when a service or evaluation routine is called (140). This may happen automatically on a periodic basis or based on the printer usage levels. Alternatively, the service/evaluation routine may be invoked selectively by the user of the printer. If the printing device is not in use, additional servicing attempts may be automatically employed, e.g., spitting, testing, wiping, etc. The device may automatically determine the best servicing algorithm for nozzle health given adverse factors, such as dust, paper fibers, temperature, humidity, etc.

When the routine is called, both nozzles in each nozzle pair are fired (141). The performance of the two nozzles is then evaluated and compared (142). As indicated above, this may be performed by optically detecting the quality of each drop emitted from a nozzle. Alternatively, this may be performed by printing a dot with each nozzle and scanning the result to identify weakly functioning or non-functioning nozzles.

The nozzle that performs best is then slated for use during printing while the less well performing nozzle is deactivated. For example, if the better result is achieved by the lower nozzle (143), however that result is evaluated, the upper nozzle is deactivated (145) and not used during subsequent printing. Alternatively, if the lower nozzle is not the better performing nozzle (143), the lower nozzle is deactivated 9146) and not used during subsequent printing.

It should be acknowledged that the better performing nozzle in a nozzle pair might change over time. Heat and mechanical shock may clear a formerly clogged nozzle. A nozzle formerly operating efficiently may become clogged or damaged. Consequently, there may be a continuing need to call the service/evaluation routine in order to consistently obtain the best print quality from the print head. This fact is illustrated in FIG. 6.

Figure 7:
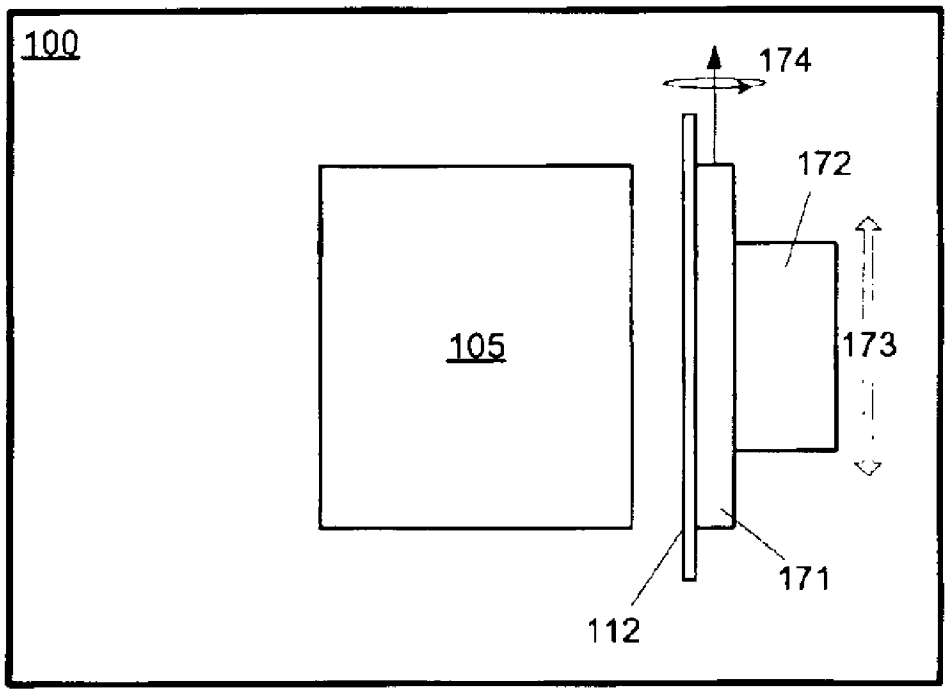
FIG. 7 is an illustration of printer which a dithering print medium to minimize the effect of non-functioning nozzles in the print head.

FIG. 7 illustrates another embodiment of the present invention in which printing quality is promoted despite malfunctioning nozzles without providing a redundant backup nozzle for each primary nozzle. Rather, the embodiment illustrated in FIG. 7 moves or dithers the print medium so as to place a target location on the print medium in front of first one nozzle and then an adjacent nozzle, or alternate nearby nozzles. As before, if two nozzles attempt to print at a given target location, the odds are vastly increased that one or both of the nozzles will successfully print to that target location and thereby enhance print quality even if some of the nozzles in the print head are malfunctioning. However, the present invention is not limited to using only two alternate nozzles. The more alternate nozzles employed within the media positioning capability, the greater the redundancy for weak or missing nozzles.

As shown in FIG. 7, an inkjet printer, for example a POS inkjet printer (100), includes an inkjet print head (105) and the components necessary to drive that print head. Additionally, a print medium transport system feeds a print medium (112) passed the print head (105) for printing.

The print medium transport system preferably comprises at least one roller (171) that rotates about a longitudinal axis as indicated by arrow (174). The rotation of the roller (171) other components of the print medium transport system feed the print medium (112) passed the print head (105).

Under principles of the present invention, the print medium transport system dither the print medium (112) with respect to the print head (105) as indicated by the arrow (173). The amount of movement of the print medium (112) is actually very small, only enough to move a target location on the print medium between two adjacent nozzles. In this way, it the nozzle has somehow failed to print the required spot at the target location, the adjacent nozzle is then fired after the print medium is moved to print the required spot. In this way, adjacent nozzles back each other up without the need to specifically provide a redundant backup nozzle for each primary nozzle in the print head as in previous embodiments.

A micro-positioning device (172) is preferably used to dither the print medium (112). The micro-positioning device (172) can be, for example, an electro-mechanical or piezoelectric device. Micro-positioning devices suitable for use in practicing the present invention are made by Physik Instrumente. The dithering of the print medium may also be accomplished by electrostatic methods.

The amount of movement required for the print medium (112) is very small. For example, given a printing resolution of 300 dots per inch, the physical spacing of adjacent nozzles is only $1/300^{th}$ of an inch. This is the distance by which the print medium (112) must be shifted to bring a target location from one nozzle to an adjacent nozzle. Alternatively, smaller offsets may be used to improve randomness of the dots on the paper and remove additional systematic errors in the writing system.

Thus, in the embodiment shown in FIG. 7, nozzles are fired to print dots to the print medium (112) to create a line within the text or image being printed. The print medium (112) is then shifted relative to the print head (105) and different nozzles are again fired at the same target locations for that line within the matter being printed. Consequently, if and nozzles are malfunctioning, the effects of the malfunction can be compensated for by an adjacent, functioning nozzle.

Figure 8:
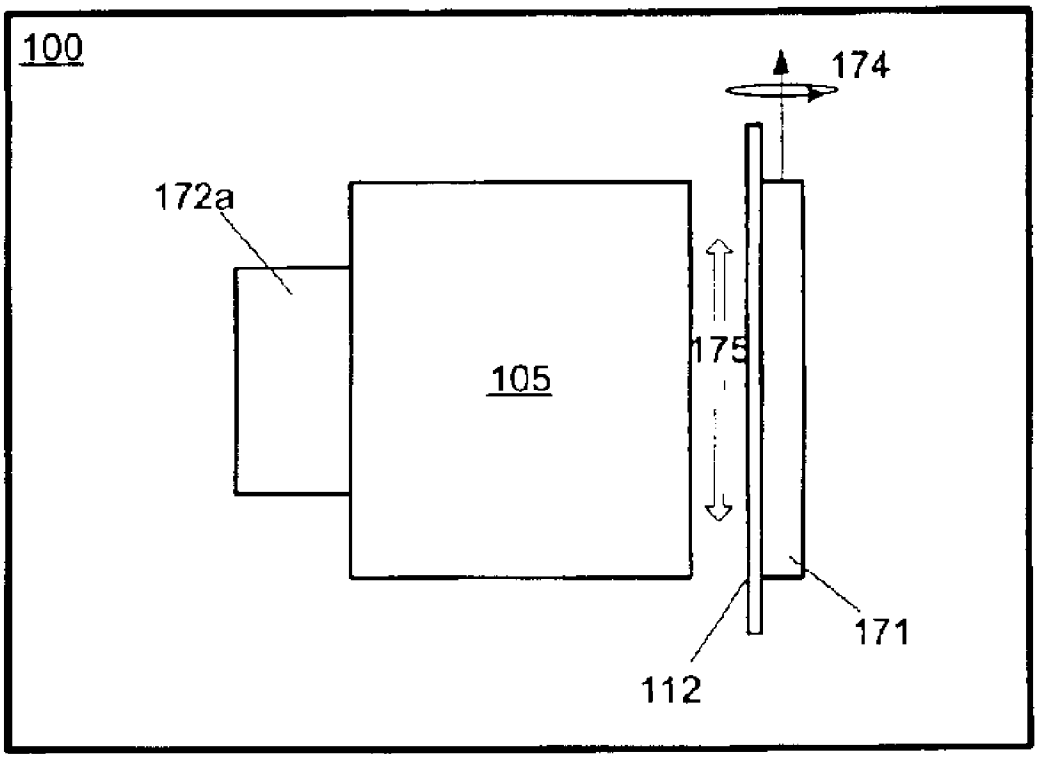
FIG. 8 is an illustration of printer which a dithering print head to minimize the effect of non-functioning nozzles in the print head.

FIG. 8 illustrates another possible embodiment of the present invention similar to that in FIG. 7. However, in FIG. 8, the print head (105) is dithered with respect to the print medium (112). A micro-positioning system (172*a*) moves the print head (105) with respect to the print medium (112) so that a new nozzle is brought to a target location where a dot is to be printed. Typically, the print head (105) is moved along an axis that is normal to the movement of the print medium (112). However, the micro-positioning system (172*a*) may move the print head (105) parallel to the movement of the print medium (112) or at an angle with both normal and parallel components relative to the movement of the print medium (112).

As before, the amount of movement required is very small. In a first position of print head (105), nozzles are fired to print dots to the print medium (112) to create a line within the text or image being printed. The print head (105) is then shifted relative to the print medium (112). Different nozzles are then fired at the same target locations for that line within the matter being printed. Consequently, if any nozzles are malfunctioning, the effects of the malfunction can be compensated for by an adjacent, functioning nozzle that is moved into position by the dithering of the print head (105).

Figure 9:
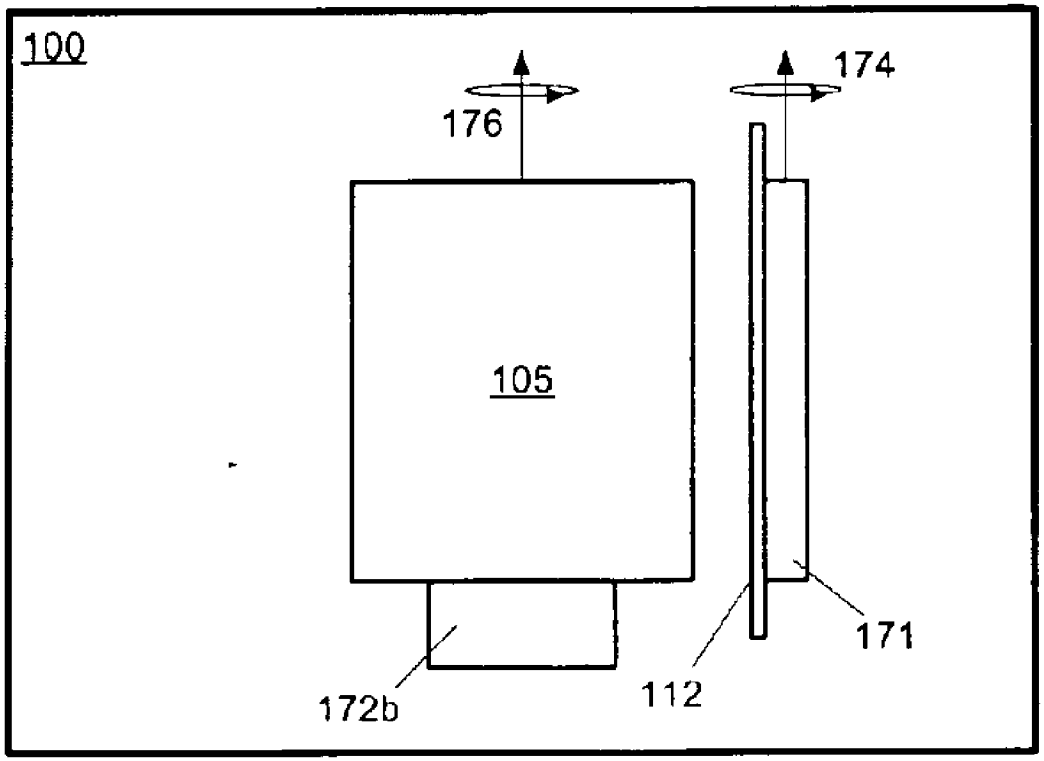
FIG. 9 is an illustration of printer which a rotating print head to minimize the effect of non-functioning nozzles in the print head.

Finally, FIG. 9 illustrates another embodiment of the present invention. In this embodiment, the print head (105) may be rotated about an axis as shown by arrow (176). A micro-positioning system **(172*b*) causes the slight rotation of the print head (105)**. The rotation may be parallel to the movement of the print medium or normal to the movement of the print medium, i.e., up and down or side-to-side.

The print head (105) is rotated a very small amount to change the vertical dot trajectory of dots emitted from the nozzles of the print head (105). In this way, again, adjacent nozzles can fill in for non-functioning or malfunctioning nozzles.

In the embodiments of FIGS. 7, 8 and 9, the print head or print medium can be continuously oscillated to promote print quality despite malfunctioning or non-functioning nozzles. If the print head or print medium system is oscillated at its native mechanical resonance frequency, the energy required to move the mass is minimized.

The foregoing embodiments have been described as examples of the present invention. The present invention is not limited to any or all of the preceding embodiments, but is defined by the scope of the following claims.

What is claimed is:

1. A fluid ejection system comprising:

a printhead including a plurality of nozzles and an orifice plate;

a micro-positioning device that dithers a print media so that at least two nozzles of the plurality of nozzles of the printhead are positioned to eject a same color ink at a substantially same position on the print media; and an optical detection system adjacent the orifice plate, the optical detection system configured to determine an optical density of ink ejected onto the print media by individual nozzles of the plurality of nozzles of the fluid ejection device, wherein the optical detection system determines which of the at least two nozzles ejects drops having a greater optical density and wherein the nozzle of the at least two nozzles with the greater optical density ejects ink while the nozzle with the lower optical density does not eject ink during operation of the fluid ejection system.

2. The fluid ejection device of claim wherein the micro-positioning device comprises a piezo-electric device.

3. The fluid ejection device of claim 1 wherein the micro-positioning device moves the printhead a distance approximately equal to a distance between the at least two nozzles.

4. The fluid ejection device of claim 3 wherein the distance is approximately equal to $1/300^{th}$ of an inch.

5. The fluid ejection device of claim 1 wherein the printhead is a thermal printhead.

6. The fluid ejection device of claim 1 wherein the plurality of nozzles are divided into nozzle pairs so that each nozzle pair is operated to are positioned to eject the same color ink at substantially same positions on the print media.

7. A fluid ejection device comprising:

a printhead including a plurality of nozzles and an orifice plate; and means for shifting a print media so that at least two nozzles of the plurality of nozzles of the printhead are positioned to eject a same color ink at a substantially same position, wherein the means for shifting moves the media a distance that is approximately equal to $1/300^{th}$ of an inch.

8. The fluid ejection device of claim 7 further comprising an optical detection system adjacent the orifice plate, the optical detection system configured to determine an optical density of ink ejected by individual nozzles of the plurality of nozzles of the fluid ejection system.

9. The fluid ejection device of claim 7 wherein the printhead is a thermal printhead.

10. The fluid ejection device of claim 7 wherein the micro-positioning device comprises a piezo-electric device.

* * * * *

UNITED STATES PATENT AND TRADEMARK OFFICE

CERTIFICATE OF CORRECTION

PATENT NO. : 6,874,862 B2
DATED : April 5, 2005
INVENTOR(S) : David A. Shade

It is certified that error appears in the above-identified patent and that said Letters Patent is hereby corrected as shown below:

Title page,
Item [57], ABSTRACT,
Line 3, please delete "passed" and insert in lieu thereof -- past --;

Column 2,
Lines 41, 44 and 47, after "of" insert -- a --, and after "printer", delete "which" and insert in lieu thereof -- with --;

Column 3,
Line 3, delete "feed" and insert in lieu thereof -- fed --;
Line 17, delete "passed" and insert in lieu thereof -- past --;

Column 4,
Line 37, delete "appropriate" and insert in lieu thereof -- appropriately --;

Column 5,
Line 9, delete "passed" and insert in lieu thereof -- past --;
Line 64, delete "actually" and insert in lieu thereof -- actual --;

Column 7,
Line 43, delete "9146)" and insert in lieu thereof -- (146) --;

Column 8,
Line 9, insert -- and -- in front of "other";
Line 12, delete "dither" and insert in lieu thereof -- dithers --.
Line 17, delete "it the nozzle" and insert in lieu thereof -- if the first nozzle --;
Line 47, delete "if and" and insert in lieu thereof -- if any --;

UNITED STATES PATENT AND TRADEMARK OFFICE

CERTIFICATE OF CORRECTION

PATENT NO. : 6,874,862 B2
DATED : April 5, 2005
INVENTOR(S) : David A. Shade

It is certified that error appears in the above-identified patent and that said Letters Patent is hereby corrected as shown below:

Column 10,
Line 7, after "claim" insert -- 1 --;
Line 20, delete "operated to are".

Signed and Sealed this

Nineteenth Day of July, 2005

JON W. DUDAS
*Director of the United States Patent and Trademark Office*